United States Patent [19]

Cillario

[11] Patent Number: 4,465,190

[45] Date of Patent: Aug. 14, 1984

[54] PACKAGE FOR FOOD PRODUCTS PARTICULARLY CONFECTIONERY PRODUCTS

[75] Inventor: Lorenzo Cillario, Alba, Italy

[73] Assignee: Ferrero S.p.A., Alba, Italy

[21] Appl. No.: 482,063

[22] Filed: Apr. 5, 1983

[30] Foreign Application Priority Data

Jul. 21, 1982 [IT] Italy ..... 53546/82[U]

[51] Int. Cl.[3] ..... B65D 85/72; B65D 81/32

[52] U.S. Cl. ..... 206/526; 206/216; 206/499; 229/2.5 R; 229/22

[58] Field of Search ..... 206/526, 216, 461, 499, 206/19; 229/2.5 R, 22

[56] References Cited

U.S. PATENT DOCUMENTS

| | | | |
|---|---|---|---|
| D. 200,555 | 3/1965 | Iwanski | 229/22 |
| 2,527,919 | 10/1950 | Drangle | 206/461 |
| 2,917,216 | 12/1959 | Despres | 206/499 |
| 3,541,029 | 5/1970 | Powell | 206/19 |
| 3,605,374 | 9/1971 | Mueller et al. | 229/2.5 R |

*Primary Examiner*—William T. Dixson, Jr.

*Attorney, Agent, or Firm*—Bernard, Rothwell & Brown

[57] ABSTRACT

The package comprises two trough-shaped containers, one of which receives a filling of a food product and the other of which receives auxiliary garnishing products intended to be applied to the food product at the moment of consumption. The containers are interconnected at their free edges with the interpositioning of a laminar sealing element.

3 Claims, 2 Drawing Figures

PACKAGE FOR FOOD PRODUCTS PARTICULARLY CONFECTIONERY PRODUCTS

TEXT OF THE DESCRIPTION

The object of the present invention is a package for food products.

The object of the invention is to provide a package which is easy to use, and simple and economical to manufacture.

In order to achieve this object, the present invention provides a package comprising two through-shaped containers, one of which receives a food product and the other of which receives a filling of auxiliary garnishing products for application to the food product at the moment of consumption, the containers being interconnected at their free edges with the interpositioning of a laminar sealing element.

By virtue of this characteristic, a package is formed which is simple and economical to manufacture, in which a food product, such as, for example, a solid or a settable confectionery product, is packaged together with auxiliary food products usable as garnishing at the moment of use.

Characteristics and advantages of the invention will become evident from the following description, given purely by way of non-limiting example with reference to the appended drawings, in which.

Figure 1:
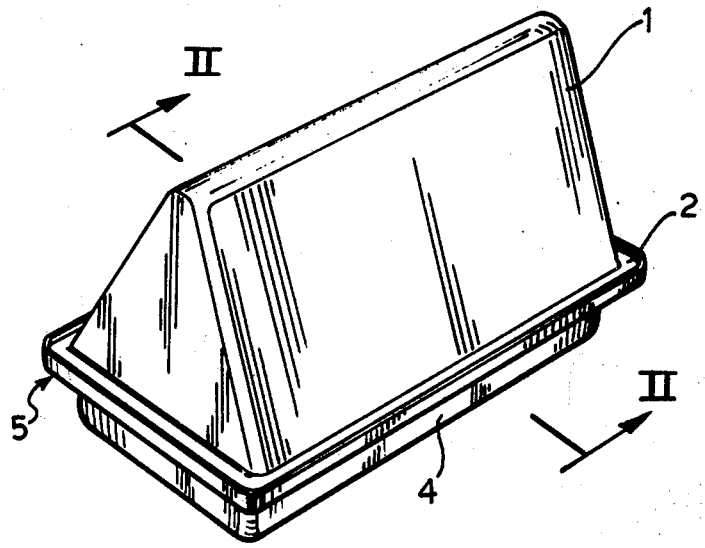
FIG. 1 is a perspective view of a package according to the invention.

In the drawings there is shown a first trough-shaped container 1 of generally prismatic form with a triangular cross-section.

The container 1 has a peripheral flange 2 around its free edge.

A laminar element 3, such as a sheet of aluminium foil, is intended to be fitted to close the container 1.

Preferably, the container 1 is formed from a plastics material, such as polythene, and the sheet 3 has a coating 3*a* of an identical plastics material.

The sheet 3 can thus be fitted to close the part 1 by means of heat-sealing on the flange 2, after a filling F of a confectionery product has been put into the trough-shaped part 1.

In a typical example of use, the product F is a liquid or semi-liquid cream which can be set by freezing.

A further through-shaped container 4 has a generally flattened form.

Around its free edge, the container 4 has a shaped flange 5 which enables the container 4 to be coupled to the container 1.

Figure 2:
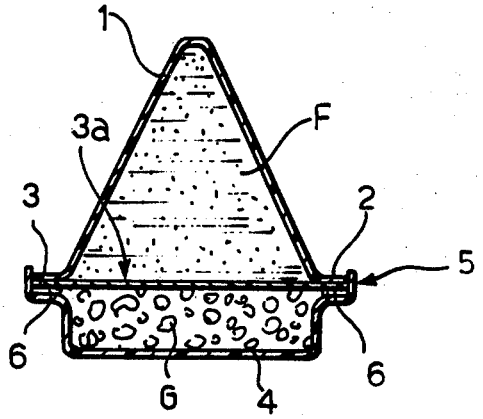
FIG. 2 is a sectional view taken on the line II-II of FIG. 1.

The shaped flange 5 may be snap-engaged with the flange 2 of the part 1; alternatively, as shown schematically in FIG. 2, the container 4 may be bonded to the part 1 by spots 6 of hot-melt adhesive.

In the coupled condition of the containers 1, 4, the laminar element 3 subdivides the internal space of the package into two chambers, one of which, is filled with the food product F as described previously.

The other chamber of the package, defined by the flattened container 4, however, can receive auxiliary garnishing products G intended to be applied to the food product F when, at the moment of use, this product F is removed from the container 1 after the package has been opened and the laminar element 3, which acts as a seal, has been removed from the container 1.

These auxiliary garnishing products, possibly wrapped in small polyethylene packets, may comprise candied fruit, hazelnut granules, powdered meringue or nougat. Alternatively, these auxiliary products may be present in the form of wafer biscuits, fruit syrups or semiliquid creams in the form of a paste.

The shape of the complete package according to the invention is such that, after its removal from the containers and possible garnishing, the product F retains its triangular prismatic shape to evoke the typical form of the ice-cream product known as a "cassata".

Naturally, the effects of the present invention also extend to models which allow equal utility to be achieved by using the same innovative concept.

What is claimed is:

1. A package comprising: a first trough shaped container for receiving a food product, said first container having a free edge and a peripheral flange around said free edge; means for sealing said container comprising a laminar sealing element attached to said flange; and a second trough-shaped container for receiving one or more auxiliary garnishing products for application to the food product at the moment of consumption, said second container having a free edge and shaped parts around said free edge of said second container which cooperate with said flange to snap-engage said shaped parts with said flange, thereby connecting said first and second containers, the laminar sealing element subdividing the internal space of the package into two chamber.

2. A package as defined in claim 1, wherein the container for the food product is of triangular prismatic form.

3. A package as defined in claim 2, wherein said second container is generally of flattened form.

* * * * *

UNITED STATES PATENT AND TRADEMARK OFFICE

CERTIFICATE OF CORRECTION

PATENT NO. : 4,465,190

DATED : August 14, 1984

INVENTOR(S) : Lorenzo Cillario

It is certified that error appears in the above-identified patent and that said Letters Patent is hereby corrected as shown below:

Col. 1, line 7, delete "object" and insert therefor -- subject --.

Col. 1, line 53, delete "through-shaped" and insert therefor -- trough-shaped --.

Signed and Sealed this

*Fifth* Day of *March 1985*

[SEAL]

*Attest:*

DONALD J. QUIGG

*Attesting Officer* *Acting Commissioner of Patents and Trademarks*